United States Patent [19]

Trygar

[11] Patent Number: 4,581,688

[45] Date of Patent: Apr. 8, 1986

[54] MECHANIC'S LAMP WITH SHIELD AND SELECTIVELY ROTATABLE SUSPENSION MEANS

[76] Inventor: Edmund A. Trygar, 128 Raritan Ave., Highland Park, N.J. 08904

[21] Appl. No.: 612,861

[22] Filed: May 22, 1984

[51] Int. Cl.[4] ..... F21V 21/28

[52] U.S. Cl. ..... 362/275; 362/285; 362/396; 362/368; 362/399; 362/376; 362/427

[58] Field of Search ..... 362/109, 119, 120, 376, 362/377, 378, 396, 399, 400, 427, 269, 275, 285, 368

[56] References Cited

U.S. PATENT DOCUMENTS

| | | | |
|---|---|---|---|
| 261,618 | 7/1882 | Lufkin | 362/399 X |
| 1,735,295 | 11/1929 | Olley | 362/400 |
| 1,760,687 | 5/1930 | Davis | 362/400 |
| 2,143,440 | 1/1939 | Hitchcock | 362/396 X |
| 2,205,496 | 6/1940 | Schneider | 362/396 X |
| 2,448,582 | 9/1948 | Fike | 362/400 X |
| 2,554,565 | 5/1951 | Fike | 362/400 X |
| 3,244,873 | 4/1966 | Leutheuser | 362/376 X |
| 4,273,803 | 6/1981 | Johnson | 362/399 |

FOREIGN PATENT DOCUMENTS

| | | | |
|---|---|---|---|
| 428437 | 10/1926 | Austria | 362/399 |
| 1039703 | 5/1976 | Canada | 362/400 |

*Primary Examiner*—Peter A. Nelson

*Attorney, Agent, or Firm*—Stanley W. Sokolowski

[57] ABSTRACT

In the preferred embodiment described and illustrated, the lamp comprises a box-like receptacle in which to confine a light. One side of the box is open, and a grid-type shield is pivotably coupled thereto, and latchingly engaged with clasps, to expose illumination from a receptacle confined light and to protect such light from damage. A hook is pivotably journalled from one end of the receptacle, for suspending the receptacle. The journalling end of the hook is U-shaped, and the journalling end of the receptacle has a plurality of detent holes formed therein, whereby the U-shaped end of the hook can be detentably engaged with any one of the detent holes to direct the illumination as desired. The exterior surfaces of the receptacle and shield are flat, to inhibit rolling of the lamp.

9 Claims, 6 Drawing Figures

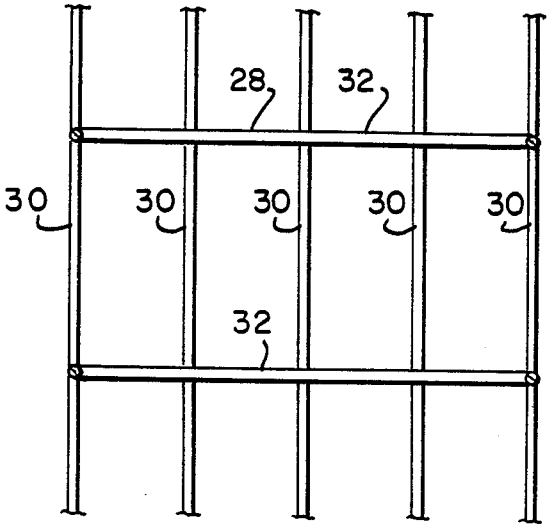
FIG. 6
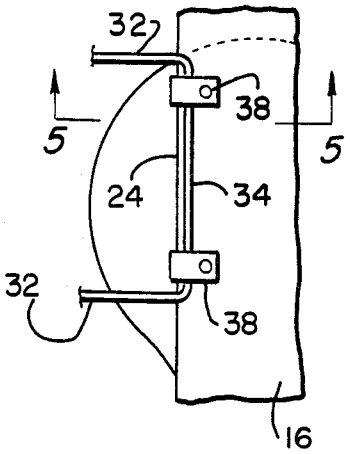
FIG. 4
FIG. 2
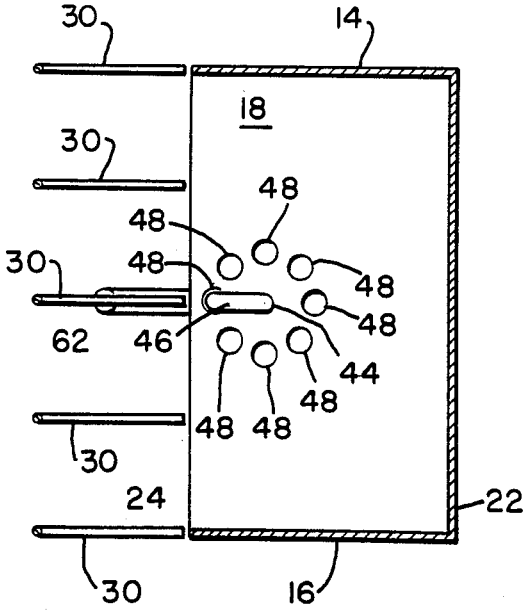
FIG. 5
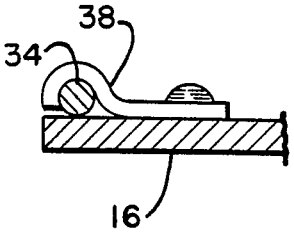

MECHANIC'S LAMP WITH SHIELD AND SELECTIVELY ROTATABLE SUSPENSION MEANS

This invention pertains to mechanic's lamps, and in particular to an improved mechanic's lamp having means which permit the user to direct the illumination thereof where desired notwithstanding the urging of the electrical extension cord thereof to give the lamp another, arbitrary illumination direction.

Those who have used the prior art type of mechanic's lamp will be familiar with the frustrations attending such use. Upon engaging the suspension hook of the lamp where, and in a given attitude, the illumination will be most favorably directed, almost invariably the electrical extension cord will cause the lamp to rotate to another position in which the illumination is of no help. Hence, in the circumstances, one removes the hook from whereat it is engaged, and endeavors to set it elsewhere to achieve the desired-direction illumination. However, here the hook may be too small, or if engageable, the cord will gyrate the lamp in a contrary direction.

What has been needed is as improved mechanic's lamp which accommodates illumination direction thereof in substantially any attitude of the suspending hook, and regardless of the biasing of the extension cord. In addition, such a lamp has been long needed which also has a hook so configured that it can be engaged with something as small in diameter as an oil line, and as large as a drive shaft.

It is an object of this invention to set forth just such an improved mechanic's lamp which avoids the shortcomings, cited in the foregoing, with simple, inexpensive manufacture.

It is particularly an object of this invention to disclose an improved mechanic's lamp comprising a receptable for confining a light therewithin; said receptacle defining a substantially rectilinear box; said box having one open side; a shield coupled to said one side for (a) exposing illumination from such light as is confined within said receptacle, and (b) for protecting such light from damage; and means coupled to said box, rotatably about an axis, for suspending said box in elevation; wherein said suspending means and said box have means cooperative for detenting said suspending means in any one of a plurality of angularly displaced dispositions relative to said axis.

Further objects of this invention, as well as the novel features thereof will become more apparent by reference to the following description, taken in conjuction with the accompanying figures, in which:

FIG. 2 is a cross-sectional view, taken along section 2—2 of FIG. 1;

FIG. 4 is a fragmentary view of the side of the lamp which is opposite the side of FIG. 1;

FIG. 5 is a cross-sectional view, taken along section 5—5 of FIG. 4; and FIG. 6 is a cross-sectional view, taken along section 6—6 of FIG. 1.

Figure 3:
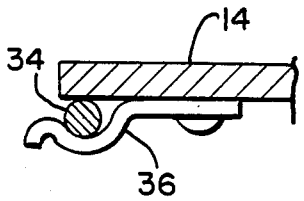
FIG. 3 is a cross-sectional view, taken along section 3—3 of FIG. 1.

As shown in the figures, an embodiment 10 of the inventive mechanic's lamp comprises a receptacle 12 of generally box shape. The receptacle has flat sides 14 and 16, flat ends 18 and 20, and a flat bottom 22. It is open at side 24, and confines a light bulb (shown in phantom) therein. End 20 accomodates a light bulb socket, and an end of an line cord, and secures them thereto by means of a clamp 26. The details of the aforesaid are not set forth here, as they are well known by those skilled in this art, and such an arrangement is common in prior art mechanic's lamps.

Figure 1:
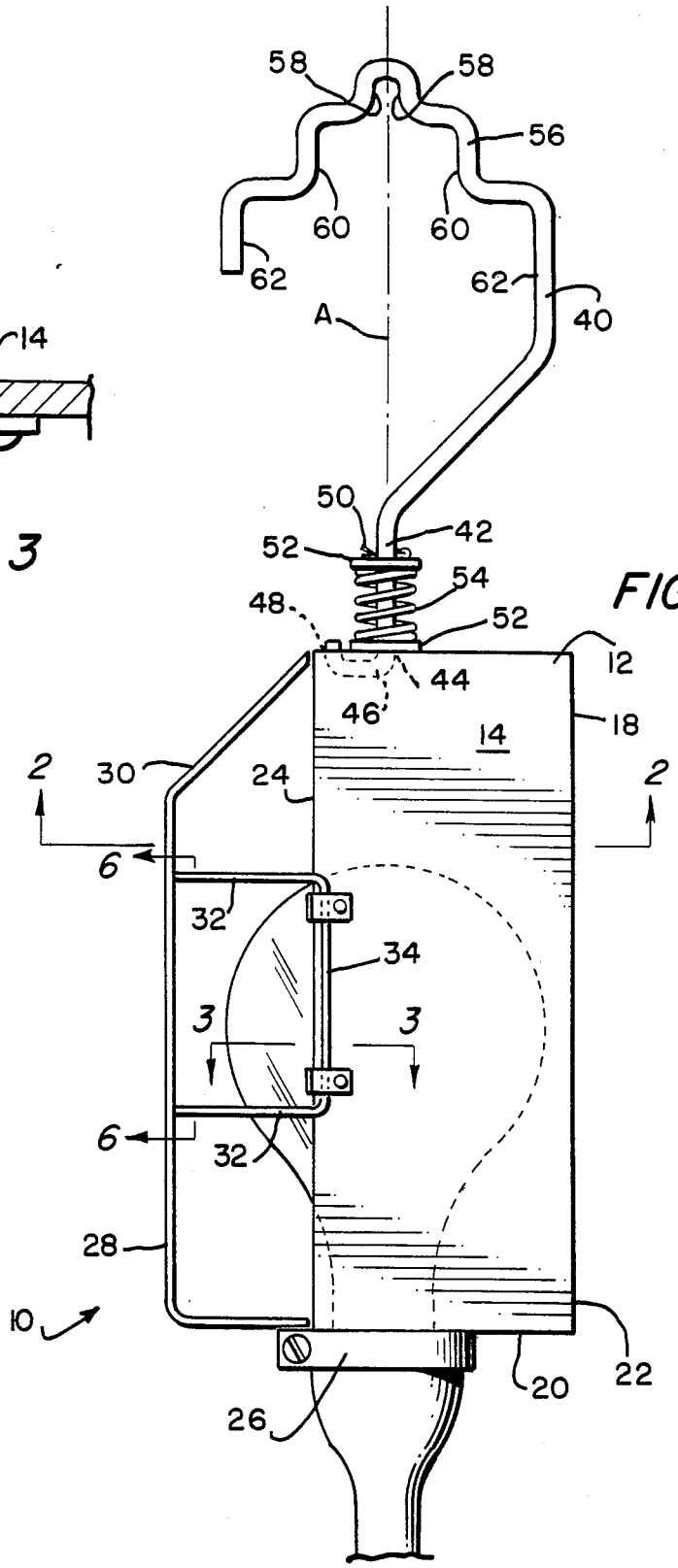
FIG. 1 is a side, elevational view of a mechanic's lamp, according to an embodiment of the invention.

A wire grid 28 is employed to shield the light bulb and to expose the illumination thereof. Grid 28 is formed of a plurality of generally axially disposed wire rods 30, and a plurality of generally transversely disposed wire rods 32. As shown in FIG. 1, rods 32 underlie rods 30. Where the rods 30 and 32 cross each other, they are welded together. Rods 32 are commonly joined, on each side of the grid 28, through linear portions 34. A pair of spring clips 36, fastened to side 14, releasably clasp one of the linear portions 34 thereto. On the other side 16, a pair of pivot clamps 38 pivotably secure the other of the linear portions 34. Accordingly, the grid 28 is pivotably mounted in the clamps 38, and is releasably latched by clips 36.

As is conventional, the lamp embodiment 10 has a suspending hook 40. Hook 40 has a shank 42, and the latter is rotatably journalled in an aperture 44 formed in end 18 of receptacle 12. However, hook 40 has a U-shaped termination 46. Further, end 18 has a plurality of detent holes 48 formed therein. The latter are provided to receive therein the end of the termination 46, as desired, to set the hook 40 and the receptacle 12 in relative angles therebetween about the axis "A".

Shank 42 has a cotter pin 50 in penetration thereof to retain a first of a pair of washers 52. A compression spring 54 circumscribes the shank 42, and is compressed between the pair of washers 52. The spring 54 is provided to retain the termination 46 in a selected detent hole 48. To set the termination in another, selected hole 48, it is only necessary to urge the hook 40 toward the receptacle 12, to disengage from one hole 48, and rotate the hook 40 to another selected hole 48.

Hook 40 has a bight 56 which is used to engage a supporting element and to suspend the lamp embodiment 10 therefrom. Now then, upon having done this, if the illumination is not properly directed, one has only to reorient the hook 40 relative to the receptacle 12, as noted in the foregoing, to have the illumination directed where desired. Any bias of the electrical extension cord will be without effect. The hook termination 46 is surely detented in the selected positioning thereof.

Bight 56 is differently and novelly undulated. It is formed with a first pair 58 of shoulders which are narrowly spaced apart, a second pair 60 which are further paced apart, and a third pair 62 which are yet further spaced apart. By this accommodation, the bight 56 is readily engageable with small diameter elements, such as oil lines, larger suspending elements, and elements as large as a drive shaft. These shoulders of graduated widths more intimately engage the selected-diameter suspending element, and further contribute to inhibiting gyration of the lamp from a desired illumination direction. In this connection it also to be noted that the sides 14 and 16, as well as the bottom of the receptacle 12 are flat, to inhibit rolling of the receptacle when it is placed on its bottom or one of its sides. The grid 28, too, is flat across the top thereof, and on the sides thereof, the cooperate with the anti-roll conformation of the receptacle 12.

While I have described my invention in connection with a specific embodiment thereof, it is to be clearly understood that this is done only by way of example, and not as a limitation to the scope of my invention as set forth in the objects thereof and in the appended claims.

I claim:

1. A mechanic's lamp, comprising:

a receptacle for confining a light therewithin;

said receptacle defining a substantially rectilinear box;

said box having one open side;

a shield coupled to said one side for (a) exposing illumination from such light as is confined within said receptacle, and (b) for protecting such a light from damage; and means coupled to said box, rotatably about an axis, for suspending said box in elevation; wherein said suspending means and said box have means cooperative for dentingly and selectively latching said suspending means to said box only in a plurality of angularly displaced and spaced-apart, rotary dispositions relative to said axis, and for resiliently restraining said suspending means in such selected, rotary dispositions, said suspending means further comprising a hook having a bight formed with a plurality of paired shoulders therein.

2. A mechanic's lamp, according to claim 1, wherein:

said box and said shield have means for inhibiting rolling of said lamp upon the latter being set to rest on any side of said box or shield.

3. A mechanic's lamp, according to claim 1, wherein:

said box and said shield are formed with flat, exterior surfaces.

4. A mechanic's lamp, according to claim 1, wherein:

said shield is pivotably coupled to said box.

5. A mechanic's lamp, according to claim 1, wherein:

said suspending means comprises a hook;

said hook having a shank, and a U-shaped termination contiguous with said shank;

said box having an end wall with an aperture formed therein; and said shank is journalled in said aperture.

6. A mechanic's lamp, according to claim 5, wherein:

said end wall has a plurality of spaced apart holes formed therein, arrayed about said aperture; and the end of said termination is detentably engaged with one of said arrayed holes.

7. A mechanic's lamp, according to claim 6, further including:

means coupled to said shank and engaging said end wall for biasingly retaining said termination end in said one hole.

8. A mechanic's lamp, according to claim 4, wherein:

each of said paired shoulders of said plurality thereof are parallel to said axis.

9. A mechanic's lamp, according to claim 4, wherein:

said box has latching means fixed thereto for releasably and latchingly clasping said shield.

* * * * *